US008516658B2

(12) United States Patent
Bultschnieder

(10) Patent No.: US 8,516,658 B2
(45) Date of Patent: Aug. 27, 2013

(54) DOOR HINGE, IN PARTICULAR FOR A BUILDING DOOR

(75) Inventor: Andre Bultschnieder, Rheda-Wiedenbrueck (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 139 days.

(21) Appl. No.: 13/046,754

(22) Filed: Mar. 13, 2011

(65) Prior Publication Data

US 2011/0219585 A1 Sep. 15, 2011

(30) Foreign Application Priority Data

Mar. 13, 2010 (DE) ..... 10 2010 011 327

(51) Int. Cl.
*E05D 7/04* (2006.01)

(52) U.S. Cl.
USPC ..... 16/246

(58) Field of Classification Search
USPC ..... 16/235–246
See application file for complete search history.

(56) References Cited

U.S. PATENT DOCUMENTS

| | | | | |
|---|---|---|---|---|
| 3,596,307 | A * | 8/1971 | Kolmetsky | 16/237 |
| 3,656,203 | A * | 4/1972 | Waflart, Jr. | 16/35 R |
| 3,680,171 | A * | 8/1972 | MacDonald | 16/58 |
| 4,434,523 | A * | 3/1984 | Grass | 16/242 |
| 5,339,493 | A * | 8/1994 | MacIntyre | 16/238 |
| 5,799,370 | A * | 9/1998 | Davidian et al. | 16/236 |
| 6,715,181 | B1 * | 4/2004 | Fries | 16/271 |
| 7,516,517 | B2 * | 4/2009 | Fries | 16/246 |
| 7,552,511 | B2 * | 6/2009 | Campbell et al. | 16/238 |
| 2008/0022491 | A1 * | 1/2008 | Campbell et al. | 16/236 |
| 2008/0307606 | A1 * | 12/2008 | Karlsson | 16/243 |
| 2010/0242227 | A1 * | 9/2010 | Tagtow et al. | 16/237 |

FOREIGN PATENT DOCUMENTS

DE 102004016769 A 10/2005

* cited by examiner

*Primary Examiner* — Victor Batson
*Assistant Examiner* — Matthew Sullivan
(74) *Attorney, Agent, or Firm* — Andrew Wilford

(57) ABSTRACT

A door hinge has a knuckle defining a pivot axis, a pair of leaves extending from the knuckle and pivotal relative to each other about the axis, a housing fixable in a door jamb or door edge, and a holder in the housing. The holder is formed by a pair of bent sheet-metal brackets together forming a cavity in which engages one of the hinge leaves. One of the brackets has a face forming an acute angle to the axis. A pair of rotatable and externally threaded spindles extending across the cavity are threaded to the one leaf such that rotation of the spindles adjusts a position of the one leaf in the cavity relative to the holder. An adjustment screw threaded in the housing bears on the angled face so that the screw can be rotated to press against the face and cam the holder axially.

9 Claims, 3 Drawing Sheets

DOOR HINGE, IN PARTICULAR FOR A BUILDING DOOR

FIELD OF THE INVENTION

The present invention relates to a hinge. More particularly this invention concerns a door hinge for an entrance door.

BACKGROUND OF THE INVENTION

A typical door hinge for use on an entrance door has a pivot or knuckle from one side of which extends a leaf attached to the door jamb and from the other side of which extends a leaf fixed to the door so that the door can pivot relative to the jamb about a normally vertical axis. In DE 10 2004 016 769 one of the leaves is simply screwed to the door and the other leaf is formed as a comb and fitted to a holder in turn set in a housing recessed in the jamb. The holder can be shifted relative to the housing for adjustment of the hinge.

In line with known approaches, the housing is fastened to the door frame. The door hinge has a comb-like free hinge leaf that is inserted into the holder of the housing, which is fastened to the door jamb and is permanently fixed thereto. The holder has a fixing plate as well as a clamping plate and is guided on spindles. By turning the spindles, the position of the holder is modifiable relative to the housing that constitutes the mounting part. The constructive design allows the door to be adjusted from side to side, that is horizontally. In addition, the position of the hinge leaf can be corrected horizontally and vertically within the holder before the hinge leaf is secured in place in the desired position between the clamping plate and the fixing plate. The known housing requires a dimensionally stable support to mount the adjustment spindles. The fixing plate and clamping plate to secure the hinge leaf must be of solid construction to as to be able to hold the weight of the door. Construction of the housing is costly and requires an installation space with a depth of 22 to 25 mm.

OBJECTS OF THE INVENTION

It is therefore an object of the present invention to provide an improved door hinge, in particular for a building door.

Another object is the provision of such an improved door hinge, in particular for a building door that overcomes the above-given disadvantages, in particular that is highly adjustable but that is of inexpensive yet rugged construction.

A further object is to provide an assembly of door, door jamb, and hinge whereby the housing of the hinge is of such small dimensions that it can be mounted in the door edge.

SUMMARY OF THE INVENTION

A door hinge has according to the invention a knuckle defining a pivot axis, a pair of leaves extending from the knuckle and pivotal relative to each other about the axis, a housing fixable in a door jamb or door edge, and a holder in the housing. The holder is formed by a pair of bent sheet-metal brackets together forming a cavity in which one of the hinge leaves is engaged. One of the brackets has a face forming a small acute angle to the axis. A pair of rotatable and externally threaded spindles extending across the cavity are threaded to the one leaf such that rotation of the spindles adjusts a position of the one leaf in the cavity relative to the holder. An adjustment screw threaded in the housing bears on the angled face so that the screw can be rotated to press against the face and cam the holder axially in the housing.

Thus according to the invention, the holder is composed of two interconnected brackets between which two adjustment spindles are pivotally mounted. The adjustment spindles pass through threaded holes of the hinge leaf inserted in the holder, with the result that the position of this leaf is adjustable by turning the adjustment spindles. According to the invention, the door hinge is no longer secured by a clamp within the housing, but instead is an integral component of the housing. Elimination of the clamp makes for very low installation depth. The brackets forming the holder are sheet-metal components formed by stamping or bending, at least one bracket having at least one angled face formed by bending. The mounting part has a threaded hole holding an adjustment screw that acts on the angled face for vertical adjustment of the holder. The angled face is a functional surface that is inexpensively fabricated by forming sheet metal, for effecting the vertical adjustment of the holder. Fabrication of the holder does not require any machining.

The adjustment screw advantageously has a conical end contacting the angled face. The adjustment screw can be, for example, a set screw.

In a preferred embodiment of the invention, the holder has angled faces at both ends that are formed by bending its sheet metal, one adjustment screw being associated with each of these faces for support and vertical adjustment. In this embodiment, the door hinge can be mounted on a right- or left-hand door.

The mounting part can be in the form of a plate and have drilled holes for fastening screws, as well as openings for screws that attach the mounting part to the holder. The openings of the mounting part through which the screws pass allow for relative corrections in the position of the holder at least vertically, preferably vertically and transversely.

In another preferred embodiment of the invention, the holder is attached at both ends to plate-like mounting parts. A continuous cover plate can be provided on the front side of the mounting parts, this plate spanning the region of the holder and forming the "housing" with the two end parts.

The holder can also be removably attached to a back plate disposed on the rear side. According to a preferred embodiment, the back plate has threaded collars provided with an internal thread and the holder is attached by screws to the back plate, the screws passing the openings of the brackets and of the hinge leaf, and being screwed into the collars. The openings are sized such that corrections in the position of the holder are possible relative to the back plate. The holder is able to be locked in place by tightening the screws.

Due to the compact design of the housing, the housing can be accommodated in a countersink in the narrow edge of the door. The subject matter of the invention therefore also includes the use of the above-described door hinge on a door that is made of wood and a door frame, the housing of the door hinge being countersunk in the narrow edge of the door and fastened to the door. A frame-side attachment component of the door is fastened to the door frame. The door hinge can be used with a standardized configuration of the holder for rabbeted and flush doors. Only the frame-side attachment component must be adapted and is a function of the design of the frame that can be provided, for example, as a block frame, casing frame, or steel frame.

BRIEF DESCRIPTION OF THE DRAWING

The above and other objects, features, and advantages will become more readily apparent from the following description, reference being made to the accompanying drawing in which.

DETAILED DESCRIPTION

Figure 2:
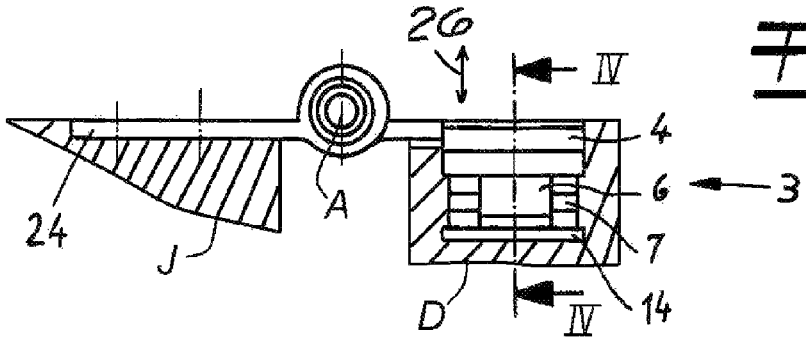
FIG. 2 is a top view of the hinge with part of the adjacent door and jamb structure shown.
Figure 1:
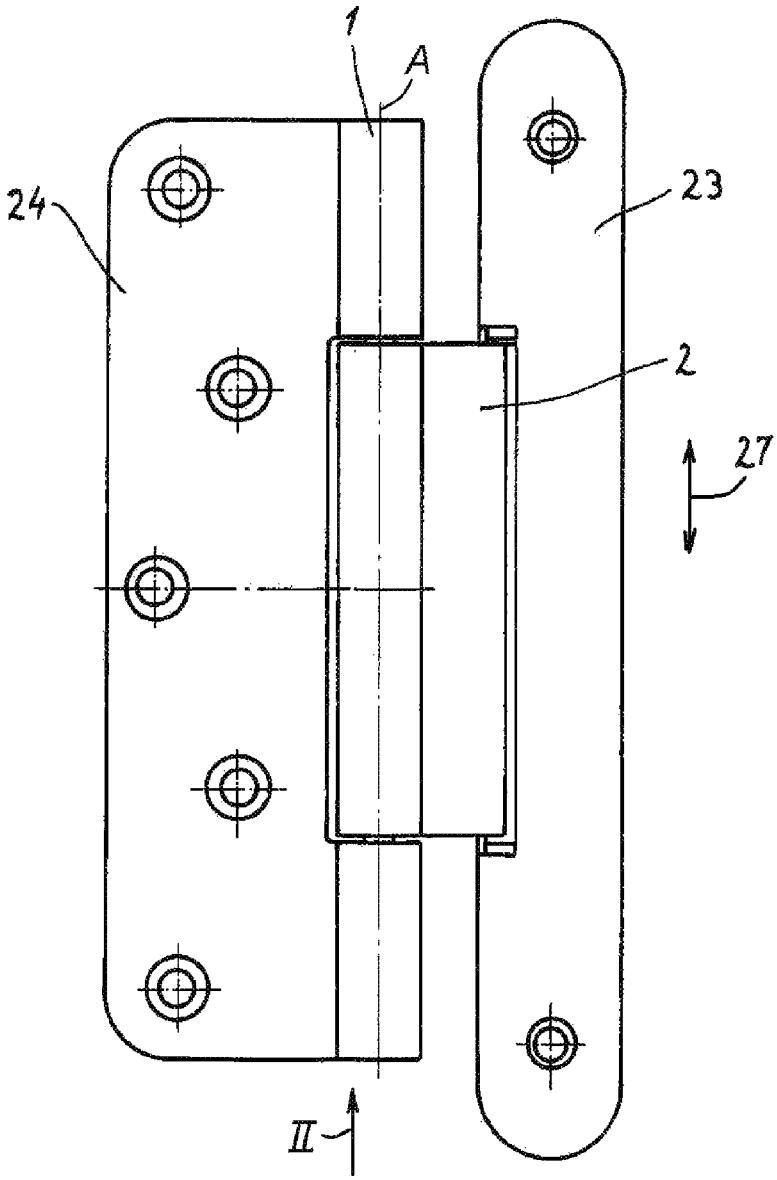
FIG. 1 is a front elevational view of the hinge in a full-open position.

As seen in FIGS. 1 and 2, a hinge according to the invention is used between a door jamb J and a door D, for pivoting of the door D relative to the jamb J about a vertical axis A parallel to the jamb J and plane of the door D. It comprises a housing 3 that is recessed in the edge of the door D and that has at its upper and lower ends cast-metal mounting parts 4 and 4' that are fixedly screwed to the door D above and below a holder 5 in which one tab or leaf 2 of the hinge is secured as will be described below. The leaf 2 is coupled at a knuckle or pivot 1 defining the axis A to another leaf 24 that is screwed to the door jamb J.

The holder 5 is formed by front and back elongated metal brackets 6 and 7 that are riveted together, that form a cavity 25 (FIG. 3) in which the leaf 2 engages, and between which two externally threaded adjustment spindles 8 are pivotally mounted for rotation about respective horizontal axes extending in a front-to-back direction 26. The spindles 8 are fitted through threaded holes of the hinge leaf 2 engaged in the cavity 25, with the result that the leaf's horizontal position in the holder 5 can be adjusted in the front-to-back direction 26 perpendicular to the axis A and parallel to the plane of the door D by turning the adjustment spindles 8 with, for instance, a hex wrench fitted to their outer ends.

Figure 3:
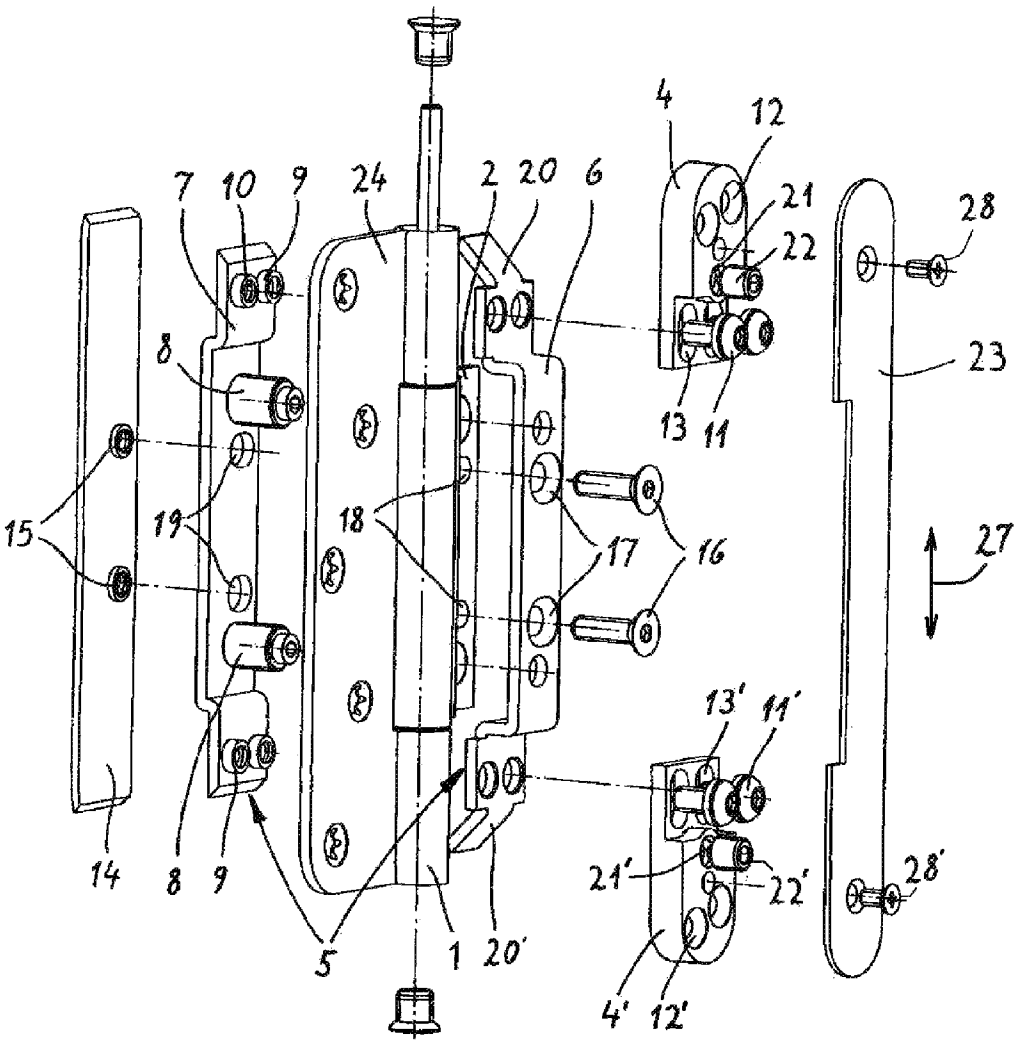
FIG. 3 is an exploded view of the hinge.

FIG. 3 shows how rivets 9 fixing together the brackets 6 and 7 are tubular and have internally threaded holes 10. The holder 5 is attached to the mounting parts 4 and 4' by screws 11 and 11' that are threaded into the holes 10 of the rivets 9. The screws 11 and 11' prevent the rivets 9 from deforming and losing their functionality, making it virtually impossible to separate the brackets 6 and 7 from each other.

The holder 5 formed by the brackets 6 and 7 is normally attached at both ends to the mounting parts 4 and 4', each of which has two drilled or punched holes 12 and 12' for unillustrated mounting screws that secure the parts 4 and 4' to the door edge and slots 13 and 13' for the screws 11 and 11' that are threaded into the rivets 9 of the holder 5. The slots 13 and 13' are vertically elongated in a direction 27 parallel to the axis A so as to enable corrections in the vertical position of the holder 5. They could also be widened horizontally to allow side-to-side adjustment.

Figure 4:
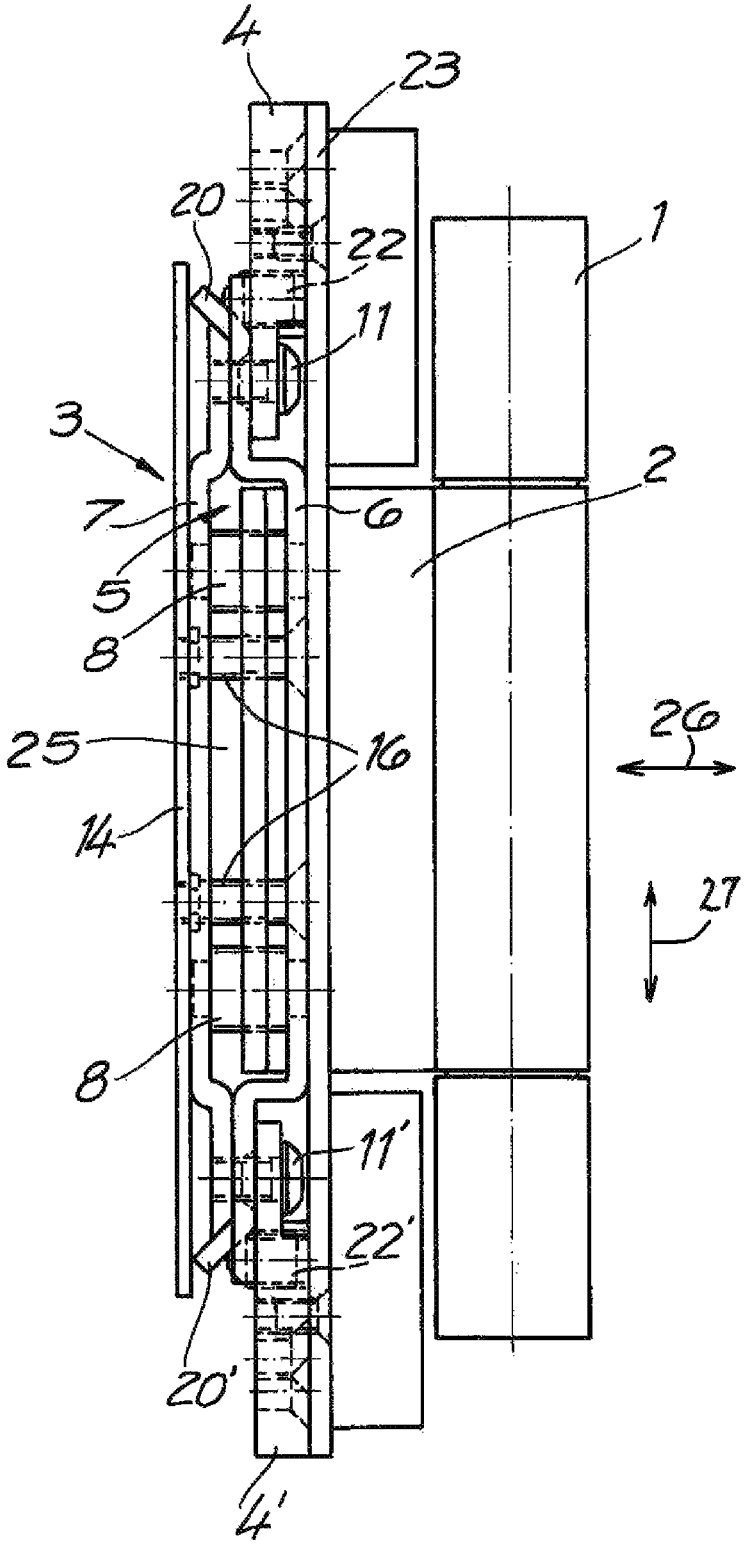
FIG. 4 is a section taken along line IV-IV of FIG. 2.

FIGS. 3 and 4 show that a back plate 14 is secured to a back face of the holder 5. The back plate 14 has forwardly directed, vertically spaced, and internally threaded collars 15, and the holder 5 is attached to the back plate 14 by screws 16 that pass in the direction 26 through holes 17 in the bracket 6, unthreaded guide holes 18 in the door leaf 2, and unthreaded holes 19 in the bracket 7 and are screwed into the collars 15. The holes 17, 18, 19 allow for vertical corrections (arrow 27) in the position of holder 5 relative to the back plate 14 when the screws 16 are loosened. The screws 16 also act as guides permitting the leaf 2 to move in the front-to-back direction 26 perpendicular to the axis A relative to the holder 5, but lock it thereto against vertical movement in the vertical direction 27. Once in the desired position, the holder 5 can be locked in place by tightening the screws 16 in the back plate 14 to pull the ends of the plate 14 forward against ends of the bracket 6 and by torquing down the screws 11 and 11' to lock the housing 3 to the holder 5. The additional screw attachment of the holder 5 to the back plate 14 improves the stability of the door hinge.

The brackets 6 and 7 forming the holder 5 are sheet-metal components fabricated by punching and bending, each having a straight and vertical central section, two short horizontal connecting sections extending from ends of the central section and forming therewith the cavity 25, and two straight and vertical end sections extending from the connecting sections and formed with holes for the screws 11. The front sheet-metal bracket 6 has angled end faces 20 and 20' formed by bending its sheet metal. The mounting parts 4 and 4' have internally threaded holes 21 and 21' in which respective set screws 22 and 22' engaging the respective angled end faces 20 and 20' of the sheet-metal bracket 6 are received. The adjustment screws 22 and 22' have conical ends that bear on the respective angled faces 20 and 20'. The position of the holder 5 in the housing 3 can be adjusted relative to the vertical direction 27 by loosening the screws 11, 11', and 16, then loosening, for example, the screws 22 and tightening the other screw 22'. This action will move the holder 6 up. Loosening the screw 22' and tightening the screw 22 will move it down. Once the desired vertical position is reached, the loosened screw 22 or 22' is tightened to lock in the vertical position of the holder 5 relative to the housing 3 and then the screws 11, 11', and 16 are tightened to lock all the parts solidly together in this position. The door hinge works equal for right- or left-hand doors.

A continuous and vertically elongated cover plate 23 is mounted on the front face of the mounting parts 4 and 4' covering the holder 5 when installed. Screws 28 and 28' secure the plate 23 to the parts 4 and 4' to form the housing 3. Normally the entire hinge assembly is installed with everything but the plate 23 in place. Then the spindles 8 are used to adjust the horizontal position of the door in the opening and the screws 22 and 22 adjusted for vertical positioning. The plate 23 is then installed to cover all the adjustment and mounting screws.

Due to its compact design, the housing 3 is well-suited for installation in the edge of a door. To this end, the housing is inserted in a mortise in the narrow edge of the door and screwed in place through the holes 12 and 12'. The door-jamb leaf 24 in this embodiment is a flat plate that can be screwed flatly against the door frame. The design of the jamb leaf 24 is dependent on the door frame, and can also be composed of pins or other fastening means.

I claim:

1. A door hinge comprising:

a pair of knuckles pivotally connected together at a pivot axis;

respective leaves extending radially from the knuckles and pivotal relative to each other about the axis;

a housing fixable in a door jamb or door edge;

a holder in the housing and formed by a pair of bent sheet-metal brackets together forming a cavity in which one of the leaves is engaged, one of the brackets having an angled face forming with the axis a small acute angle;

a pair of rotatable and externally threaded spindles pivotally supported by the brackets extending across the cavity and threaded to the one leaf such that rotation of the spindles adjusts a position of the one leaf in the cavity in a direction perpendicular to the axis relative to the holder; and at least one adjustment screw threaded in the housing, rotatable relative the housing for movement perpendicular to the axis, and bearing directly on the angled end face, whereby when screwed into the housing the screw can press against the face and cam the holder and the one hinge leaf axially in the housing.

2. The door hinge defined in claim 1 wherein the adjustment screw has a conically pointed tip engaging the angled face.

3. The door hinge defined in claim 1 wherein the housing has end parts adapted for fixation to the door jamb or door edge and a removable cover plate extending between and engaging the end parts.

4. The door hinge defined in claim 1 wherein the brackets are riveted together.

5. The door hinge defined in claim 1 wherein the holder further comprises a back plate, on a side turned away from the knuckle.

6. The door hinge defined in claim 1 wherein the housing is fitted to a narrow edge of the door.

7. A door hinge comprising:

a knuckle defining a pivot axis;

a pair of leaves extending from the knuckle and pivotal relative to each other about the axis;

a housing fixable in a door jamb or door edge;

a holder in the housing and formed by a pair of bent sheet-metal brackets together forming a cavity in which one of the leaves is engaged, one of the brackets having a face forming a small acute angle to the axis, the holder having a pair of opposite ends one of which is formed with the angled face and the other of which is also formed with a second angled face;

a pair of rotatable and externally threaded spindles extending across the cavity and threaded to the one leaf such that rotation of the spindles adjusts a position of the one leaf in the cavity relative to the holder;

a first adjustment screw threaded in the housing and bearing on one of the angled faces, whereby the screw can press against the one face and cam the holder axially in the housing; and a second such adjustment screw engaging the other of the angled faces.

8. A door hinge comprising:

a knuckle defining a pivot axis;

a pair of leaves extending from the knuckle and pivotal relative to each other about the axis;

a housing fixable in a door jamb or door edge and having end parts adapted for fixation to the door jamb or door edge and a removable cover plate extending between and engaging the end parts, each of the end parts being formed with at least one vertically elongated and horizontally throughgoing slots;

a holder in the housing and formed by a pair of bent sheet-metal brackets together forming a cavity in which one of the leaves is engaged, one of the brackets having a face forming a small acute angle to the axis;

respective mounting screws extending through the slots and threaded into the holder, whereby when the mounting screws are loosened the holder can move vertically limitedly on the housing and when they are tightened the holder is fixed on the housing;

a pair of rotatable and externally threaded spindles extending across the cavity and threaded to the one leaf such that rotation of the spindles adjusts a position of the one leaf in the cavity relative to the holder; and an adjustment screw threaded in the housing and bearing on the angled face, whereby the screw can press against the face and cam the holder axially in the housing.

9. A door hinge comprising:

a knuckle defining a pivot axis;

a pair of leaves extending from the knuckle and pivotal relative to each other about the axis;

a housing fixable in a door jamb or door edge and having a back plate on a side turned away from the knuckle;

a holder in the housing and formed by a pair of bent sheet-metal brackets together forming a cavity in which one of the leaves is engaged, one of the brackets having a face forming a small acute angle to the axis;

a pair of rotatable and externally threaded spindles extending across the cavity and threaded to the one leaf such that rotation of the spindles adjusts a position of the one leaf in the cavity relative to the holder;

an adjustment screw threaded in the housing and bearing on the angled face, whereby the screw can press against the face and cam the holder axially in the housing; and horizontal mounting screws extending parallel to the spindles through the holder and through the one leaf and screwed into the back plate, whereby the mounting screws act as guides permitting horizontal movement of the one leaf and impeding vertical movement thereof.

* * * * *